United States Patent [19]

Liberboim

[11] 4,433,803

[45] Feb. 28, 1984

[54] TENNIS BALL HOLDER BELT

[76] Inventor: Gidon Liberboim, 5938 Yarwell, Houston, Tex. 77096

[21] Appl. No.: 290,869

[22] Filed: Aug. 7, 1981

[51] Int. Cl.[3] ..... A45C 11/00

[52] U.S. Cl. ..... 224/251; 224/919

[58] Field of Search ..... 224/919, 223, 224, 191, 224/226, 251; 206/315 B, 315.9

[56] References Cited

U.S. PATENT DOCUMENTS

| | | | |
|---|---|---|---|
| 2,558,382 | 6/1951 | Previdi | 224/919 X |
| 3,212,690 | 10/1965 | Green | 224/904 X |
| 4,042,156 | 8/1977 | Knight | 224/919 X |
| 4,062,482 | 12/1977 | Szalony | 224/919 X |
| 4,079,871 | 3/1978 | Sica | 224/919 X |

FOREIGN PATENT DOCUMENTS

| | | | |
|---|---|---|---|
| 2712090 | 9/1978 | Fed. Rep. of Germany | 224/226 |
| 2752668 | 5/1979 | Fed. Rep. of Germany | 224/919 |
| 2491343 | 4/1982 | France | 224/191 |

*Primary Examiner*—Steven M. Pollard
*Assistant Examiner*—David Voorhees
*Attorney, Agent, or Firm*—Pravel, Gambrell, Hewitt, Kirk & Kimball

[57] ABSTRACT

A tennis ball holder belt having suitable fasteners to connect the belt on a tennis player and the belt having at least two ball holder panels attached thereto. The panels can be either permanently sewn to the belt or be temporarily affixed by means of snaps or other fasteners. Each panel has pockets for holding at least six tennis balls. In the conventional pocket arrangement, each panel has three upwardly facing pockets and three downwardly facing pockets. Alternatively, elastic strips attached to the panels are used as pockets, preferably with reticulated polymer surface therein to assist in retaining the tennis balls within the elastic pocket.

17 Claims, 4 Drawing Figures

TENNIS BALL HOLDER BELT

BACKGROUND OF THE INVENTION

1. Field of the Invention

The invention relates to a belt for holding a large number of tennis balls at one time.

2. Description of the Prior Art

Over the years, many devices have been developed in an effort to provide a suitable means for holding balls used in sports, e.g. golf, tennis, etc. Players of tennis, particularly, have not previously had suitable means of holding on their person a sufficient, practical number of tennis balls for practice sessions. This is particularly important when practicing serving the ball.

A recently issued patent to Norman Szalony, U.S. Pat. No. 4,062,482, provides a one-piece plastic clip, for holding tennis balls, which can be clipped on the top edge of a wearer's garment. The clip is designed for holding two to three tennis balls within the clip. A serious drawback to this design is the potential injury that could be inflicted to a player's arm if the arm strikes the plastic clip. Other sport ball clip on devices are referred to in the Szalony patent.

An alternative ball holder is shown in U.S. Pat. No. 2,508,190, issued to W. T. Previdi in 1950, which is shown to consist of a belt having an enclosed arrangement of two pockets for holding golf balls. The pocket may be worn inside or outside the belt.

Another two golf ball pocket arrangement is shown in U.S. Pat. No. 2,558,382, also issued to W. T. Previdi, which comprises a clip on device that may be worn clipped to a golf player's belt. This device also provides for golf tees that may be inserted and carried on the upper part of the clip on device.

SUMMARY OF THE INVENTION

The present invention provides for a tennis ball holder belt comprising an elongated strip of material suitable for wear by humans, having two connectable ends thereof, with means on each end of said elongated strip for connecting said two ends to form a belt, said belt having at least two panels attached thereto with each of said panels having a plurality of pocket members, with each pocket member having at least one opening for receiving and holding securely therein a tennis ball, and associated with each pocket is means for restraining said tennis ball within said pocket.

It is an object of the invention to provide a belt, to be worn while playing tennis, having a large number of pockets therein, for holding tennis balls in a secure manner while providing easy removal of each ball from each said pocket.

An additional object is to provide a tennis ball holder belt having a large number of pockets for holding tennis balls, placed on removable panels whereby a number of preloaded panels may be used with a single belt.

Yet another object of the invention is to provide on a tennis ball holder belt elastic strips sized to hold tennis balls thereunder, as in a pocket, with a reticulated polymer material therein to help secure the tennis ball under the elastic strip.

Other objects and details of the invention will become apparent from the following description, when read in conjunction with the accompanying drawings.

PREFERRED EMBODIMENTS OF THE INVENTION

Figure 1:
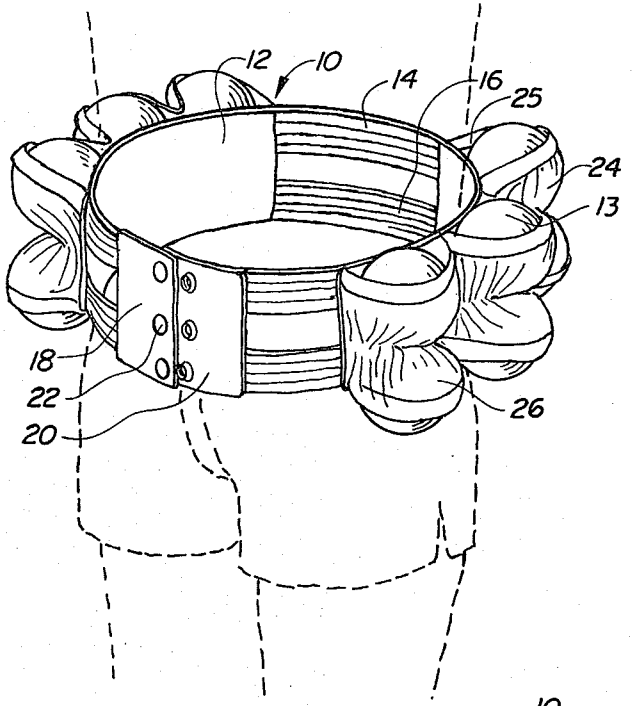
FIG. 1 is a perspective view of one embodiment of the tennis ball holder belt of the invention illustrating the manner in which the belt is worn, while loaded with tennis balls.

In the drawings, like numbers refer to like parts. In FIG. 1, there is illustrated one embodiment of a tennis ball holder belt 10, fitted around and being worn by a human. The belt 10 comprises a elongated strip 14 and 16 of material suitable for wear by humans, having two connectable ends 18 and 20 thereof. Each end 18 and 20, of the belt 10, has means 22 and 23*a*, 23*b*, respectively, for connecting the two ends 18 and 20 to form a belt 10.

Figure 2:
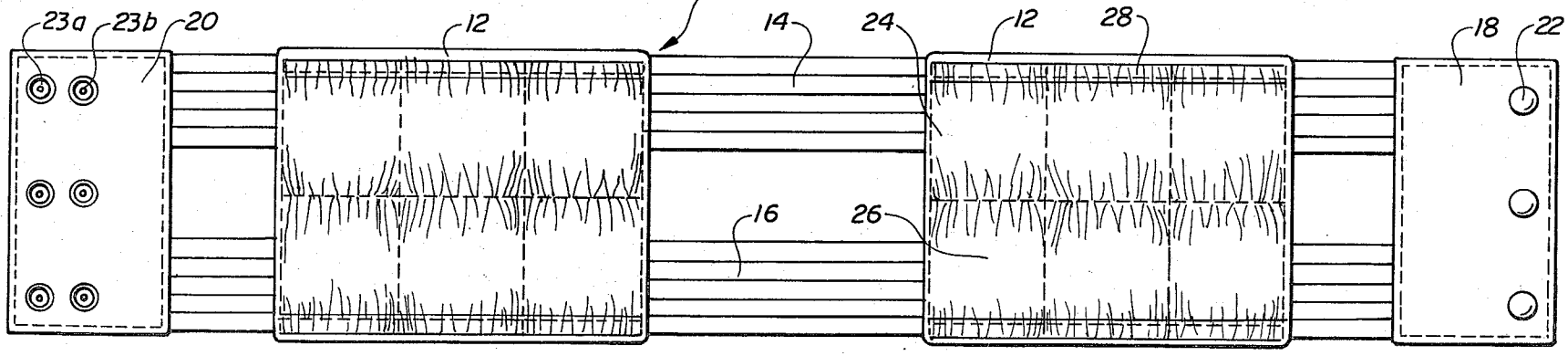
FIG. 2 is an elevational view of the embodiment of the invention shown in FIG. 1.

The belt 10 can be constructed from a variety of materials. As illustrated in FIGS. 1 and 2, the elongated strip actually consists of at least two different materials. The portion of the belt 10 that would be at the back is preferably an elastic strip, which may be a single band (not shown) or two separate strips 14 and 16. Of course, this can be leather, cloth, canvas or any material desired. The elastic permits construction of perhaps three general sizes of belts 10 which are adjustable by merely stretching the elastic strips 14 and 16. The elastic strips 14 and 16 are the preferred embodiment.

The elongated strip 14 and 16 has two ends 18 and 20 and means 22 and 23*a*, 23*b* thereon, respectively, for fastening the ends together. It is preferred that the fastening means be mechanical fasteners such as the snaps 22 and 23*a*, 23*b*. Of course it is understood that the fastening means may be a buckle or some other suitable device such as a reticulated polymer material, referred to in the trade by the trademark Velcro, manufactured by Textron, Inc. The ends 18 and 20 can be made from leather, canvas or cloth material.

It is preferred that the belt 10 have attached thereto at least two panels 12, shown in FIG. 1 to be positioned in such manner that when the belt 10 is worn they would be on each side of the wearer. This would provide each access to the wearer. The panels may be of any suitable material, such as canvas, leather or suitable cloth material.

Each panel 12 has a plurality of pocket members 24, with each pocket member having at least one opening 25 for receiving and holding securely therein a tennis ball 13. There is associated with each pocket member means 28 for restraining the tennis ball 13 within the pocket 24. The means 28, shown in FIG. 1 may be an elastic strip or wire or some other means for providing restraining means to the opening 25 of the pocket 24.

In the preferred embodiment of the invention, shown in FIGS. 1 and 2, each panel 12 has six pockets 24 and 26, with the material forming the pockets 24 stitched so as to provide an equal number of upwardly and downwardly facing pockets 24 and 26. In the illustration there are three pockets 24 facing upwardly and three pockets 26 facing downwardly when the belt 10 is being worn. In other words, the six pockets are arranged on the panel 12 in a manner where three of the pockets 24 have an opening oriented 180° to the other three pockets 26.

Figure 3:
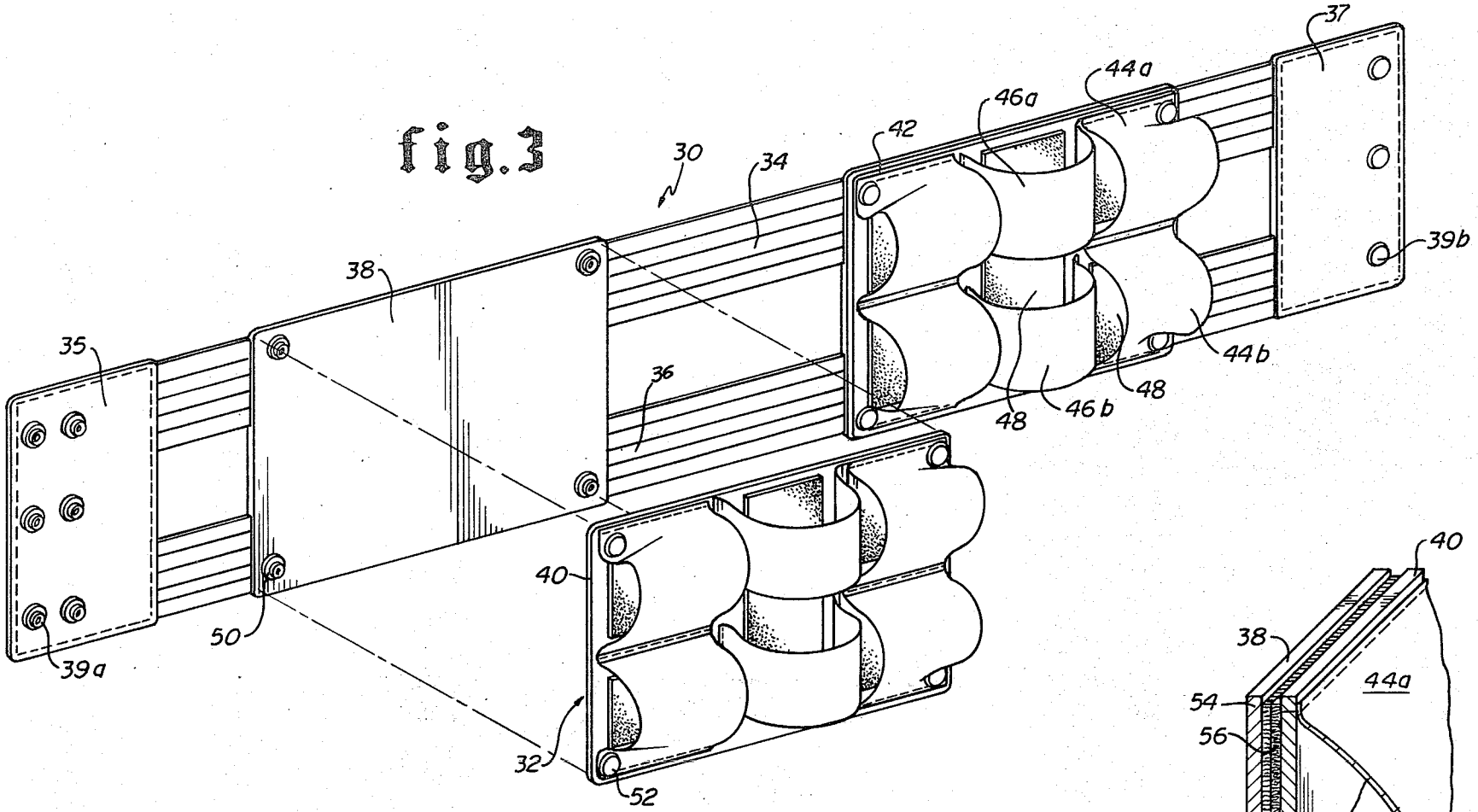
FIG. 3 is a perspective view of a second embodiment of the invention, showing removable tennis ball pocket panels and a second embodiment of the pockets.

In FIG. 3, there is shown a second embodiment of the invention wherein the belt 30 has at least two panels 38 permanently attached to the elongated strips 34 and 36 with means 39*a* and 39*b*, respectively, for fastening the ends of the strips 35 and 37 to form a belt 30 that may be worn on the waist of a human.

There are provided pocket members 44*a*, 44*b*, 46*a*, and 46*b* for receiving and holding securely therein a tennis ball (not shown). The pockets 44 and 46 are attached, by suitable means, to a panel member 40 and 42 which may be releasably connected to the panel member 38 which is itself permanently affixed to the belt 30. The releasably connected panel member is designated in FIG. 3 by numeral 32.

In this manner a tennis player can utilize any number of preloaded ball holder panels 40 and 42. When the ball holder panels 40 and 42 are empty the player can merely disconnect the panels 40 and 42 and place new panels 40 and 42, which contain tennis balls, onto the permanent belt panels 38.

One means for releasably connecting the ball holder panels 40 and 42 to the belt 30 is by using mechanical fasteners such as the snaps 50, 52 as shown in FIG. 3. Thus, the ball holder panels 40 and 42 can be merely snapped onto the belt panel 38.

Figure 4:
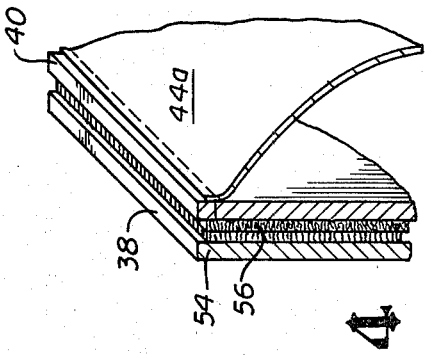
FIG. 4 is a section view of a portion of the belt of the invention showing a reticulated polymer fastening means retaining a portion of a pocket panel to the belt.

An alternative means for releasably connecting the ball holder panel 40 to the belt panel 38 is by using a reticulated polymer material 54, 56 as illustrated in FIG. 4. In this embodiment of the invention a strip of Velcro is attached to both panel facing surfaces that must be connected. When the Velcro surfaces are placed together, they secure themselves together, as is well known to the public.

The pocket members 44 and 46, shown in FIG. 3, have two openings therein due to the fact that there is used an elastic strip of material which is attached to the ball holder panel 40 and 42 in some suitable manner to provide a recepticle for a tennis ball. The elastic pocket would be sized to require some stretching of the elastic in order to place the ball in the pocket.

There can also be provided within each elastic pocket 44*a*, 44*b*, 46*a* and 46*b* a reticulated polymer material 48. This material 48 may be affixed to the inside surface of the elastic material or on the outward surface of the ball holder panel 40 and 42. Tennis balls have a fuzzy surface which becomes entangled in the reticulated polymer material 48, assisting in restraining the balls within the pockets 44*a*, 44*b*, 46*a* and 46*b*.

The elastic strips may be attached to the ball holder panel 40 and 42 in a manner that provides two pocket members 44*a* and 44*b* from a single long strip, or short individual strips may be attached to form a single pocket 46*a* and 46*b*. It is preferred that a combination of these techniques be used to form on each end of each panel 40 and 42 the double pockets 44*a* and 44*b* from a single long strip of elastic material, with the openings of the pockets being aligned with the longitudinal axis of the belt 30. The middle pockets 46*a* and 46*b* are then formed individually and have their openings perpendicular to the longitudinal axis of the belt 30. This provides easier access to all of the pockets contained on the ball holder panel 40 and 42.

I claim:

1. A tennis ball holder belt comprising:

an elongated strip of material suitable for wear by humans, having two connectable ends thereof;

means for connecting said two ends to form a belt;

said belt having at least two panels attached thereto;

each of said panels having a plurality of rows, said rows including a plurality of pocket members, with each pocket member having at least one opening for receiving substantially an entire tennis ball and holding it securely therein;

said panels having an uppermost row of pocket members;

said panels having a lowermost row of pocket members;

at least one of said openings of said pocket members in said uppermost row are oriented 180° to at least one opening on said pocket members in said lowermost row;

whereby when said belt is worn, at least one opening in said pocket member in said uppermost row is upwardly directed and at least one opening in said pocket member in said lowermost row is downwardly directed; and, an elastic restraining means associated with each pocket member for receiving and encircling the periphery of the tennis ball thereby retaining said tennis ball substantially in said pocket.

2. The tennis ball holder belt of claim 1, wherein there are at least three pockets on each of said rows.

3. The tennis ball holder belt of claim 2, wherein:

said three pockets on said uppermost row are arranged in a manner where three of said pockets in said uppermost row have an opening oriented 180° to said three pockets in said lowermost row.

4. The tennis ball holder belt of claim 1, wherein there are two panels attached thereto and said panels are separated from each other by elastic means.

5. The tennis ball holder belt of claim 1, wherein said panels are detachable from said belt and are held thereon by releasable connecting means.

6. The tennis ball holder belt of claim 5, wherein said releasable connecting means comprise snaps affixed to said panel and said belt.

7. The tennis ball holder belt of claim 5, wherein said releasable connecting means comprise reticulated polymer fastener material attached to said panel and said belt.

8. The tennis ball holder belt of claim 1, wherein there is positioned within said pocket member, a reticulated polymer fastener material to assist in retaining said tennis ball within said pocket member.

9. The tennis ball holder belt of claim 8, wherein said reticulated polymer material is attached to said panel within said pocket.

10. The tennis ball holder belt of claim 1, wherein there is positioned within said pocket member a reticulated polymer material to assist in holding said tennis ball within said pocket member.

11. The tennis ball holder of claim 10, wherein said reticulated polymer material is attached to said panel.

12. The tennis ball holder belt of claim 1, wherein at least one of said panels is releasably attachable to said belt.

13. A tennis ball holder belt comprising:

an elongated strip of material suitable for wear by humans, having two connectable ends thereof;

means for connecting said two ends to form a belt;

said belt having at least two panels attached thereto;

each of said panels having a plurality of rows, said rows including a plurality of pocket members, with each pocket member having two openings 180° opposed from each other for receiving substantially an entire tennis ball and holding it securely therein;

said panels having an uppermost row of pocket members;

said panels having a lowermost row of pocket members;

at least one of said openings of said pocket members in said uppermost row are oriented 180° to at least one opening on said pocket members in said lowermost row;

whereby when said belt is worn, at least one opening in said pocket member in said uppermost row is upwardly directed and at least one opening in said pocket member in said lowermost row is downwardly directed; and, an elastic strip attached to said panel thereby forming at least one of said pocket members, said strip adapted to receive and encircle the periphery of the tennis ball thereby retaining said tennis ball in said pocket.

14. The tennis ball holder of claim 13, wherein:

at least one of said openings in at least one of said pocket members in said uppermost row is 90° to at least one of said openings in another pocket member in said uppermost row.

15. The tennis ball holder of claim 14, wherein:

at least one opening in at least one of said pocket members in said lowermost row is 90° to at least one opening in another pocket member in said lowermost row.

16. The tennis ball holder of claim 13, wherein:

a first snap connection is affixed to said panel; and, a second snap connection is affixed to said belt, thereby permitting releasable mounting of said panel on said belt.

17. The tennis ball holder belt of claim 13, wherein:

a first reticulated polymer fastener material is attached to said panel; and, a second reticulated polymer fastener material is attached to said belt, thereby permitting a releasable connection between said panel and said belt.

* * * * *

UNITED STATES PATENT AND TRADEMARK OFFICE

CERTIFICATE OF CORRECTION

PATENT NO. : 4,433,803

DATED : February 28, 1984

INVENTOR(S) : Gidon Liberboim

It is certified that error appears in the above-identified patent and that said Letters Patent are hereby corrected as shown below:

In Column 4, Line 54, please delete "pocket." and insert therefor --pocket member.-- .

In Column 4, Line 55, please delete "claim 1" and insert therefor --claim 13-- .

Signed and Sealed this

*Fifth* Day of *June 1984*

[SEAL]

*Attest:*

GERALD J. MOSSINGHOFF

*Attesting Officer*

*Commissioner of Patents and Trademarks*